US006752490B2

(12) United States Patent
Pickrell

(10) Patent No.: US 6,752,490 B2
(45) Date of Patent: Jun. 22, 2004

(54) MICRO FLUID DISPENSERS USING FLEXIBLE HOLLOW GLASS FIBERS

(76) Inventor: David J. Pickrell, 160 Middle St., Pleasant Gap, PA (US) 16823

( * ) Notice: Subject to any disclaimer, the term of this patent is extended or adjusted under 35 U.S.C. 154(b) by 0 days.

(21) Appl. No.: 10/248,957

(22) Filed: Mar. 5, 2003

(65) Prior Publication Data

US 2003/0169315 A1 Sep. 11, 2003

Related U.S. Application Data

(60) Provisional application No. 60/362,279, filed on Mar. 7, 2002.

(51) Int. Cl.[7] ..... B41J 2/045
(52) U.S. Cl. ..... 347/68
(58) Field of Search ..... 347/68–72, 85

(56) References Cited

U.S. PATENT DOCUMENTS

| | | | | | |
|---|---|---|---|---|---|
| 3,828,357 | A | * | 8/1974 | Koeblitz | 347/10 |
| 4,005,440 | A | | 1/1977 | Amberntsson | 347/68 |
| 4,019,886 | A | | 4/1977 | Hoffman | 65/43 |
| 4,047,186 | A | | 9/1977 | Kendall | 347/47 |
| 4,112,436 | A | | 9/1978 | Cone | 347/47 |
| 4,224,627 | A | | 9/1980 | Powell | 347/68 |
| 4,364,068 | A | | 12/1982 | Lewis | 347/71 |
| 4,418,354 | A | * | 11/1983 | Perduijn | 347/68 |
| 4,421,706 | A | | 12/1983 | Feenstra | 264/157 |
| 4,429,322 | A | | 1/1984 | Dressler | 347/47 |
| 4,513,297 | A | * | 4/1985 | Okamura | 347/85 |
| 4,549,188 | A | | 10/1985 | Shackleton | 347/47 |
| 4,630,072 | A | | 12/1986 | Scardovi | 347/94 |
| 4,675,043 | A | | 6/1987 | Conta | 65/160 |
| 4,786,303 | A | | 11/1988 | Padalino | 65/439 |
| 4,834,637 | A | | 5/1989 | Conta | 425/110 |
| 5,927,547 | A | | 7/1999 | Papen | 222/57 |
| 6,079,283 | A | | 6/2000 | Papen | 73/864.11 |
| 6,083,762 | A | | 7/2000 | Papen | 436/180 |
| 6,094,966 | A | | 8/2000 | Papen | |
| 6,112,605 | A | | 9/2000 | Papen | 73/864.22 |
| 6,203,759 | B1 | | 3/2001 | Pelc | 422/100 |
| 6,336,708 | B1 | | 1/2002 | West et al. | 347/47 |

* cited by examiner

*Primary Examiner*—Judy Nguyen
(74) *Attorney, Agent, or Firm*—John J. Elnitski, Jr.

(57) ABSTRACT

A micro fluid dispenser including reservoir, glass tube, hollow glass fiber, a piezoelectric element and a controller. The reservoir is to hold fluid to be dispensed. The glass tube has a first end, a second end and a tube body. The first end of the glass tube is connected to the reservoir to receive the fluid. There is a hollow glass fiber for each glass tube. The hollow glass fiber has a first end, a second end and a fiber body. The first end of the hollow glass fiber is connected to the second end of the glass tube to receive the fluid. The second end of the hollow glass fiber has an open tip to act as a nozzle to dispense the fluid. The piezoelectric element forces the fluid out of each of the open tip. The controller controls activation of the piezoelectric element.

39 Claims, 12 Drawing Sheets

MICRO FLUID DISPENSERS USING FLEXIBLE HOLLOW GLASS FIBERS

CROSS REFERENCE TO RELATED APPLICATION

This application claims the benefit of and incorporates by reference U.S. Provisional Application No. 60/362,279 filed Mar. 7, 2002.

BACKGROUND OF INVENTION

The present invention generally relates to micro fluid dispensers using glass fibers. More specifically, the present invention relates to micro fluid dispensers using hollow glass fibers and piezoelectric material in ink print heads, as well as other applications.

A piezoelectric ink jet printer is a device that prints ink onto a variety of surfaces including paper. These printers use piezoelectric materials in various structures to force droplets of ink out of tiny nozzles. These drops shoot through the air to impact onto the paper or printing surface which passes below the print head. The ink rapidly dries on the paper. The accumulation of droplets from various nozzles on the print head forms characters on the paper surface. Usually, the paper moves underneath the printer to produces a continuous printing process. In low price consumer printers the printing mechanism is built into the printer. In higher cost industrial systems, such as those used for printing of signs or bar code labels onto boxes, the print head is actually a discrete unit from the rest of the printing system. Industrial print heads have many nozzles or channels to shoot out ink, typically from sixteen (16) to one-hundred-and-twenty-eight (128).

A piezoelectric is a material which will expand or contract when a voltage is applied to it. Conversely it can also generate a voltage or current when it is compressed or expanded. Typically, the piezoelectric material used in an ink jet print head is a ceramic based on the general chemical composition of Pb(Ti,Zr)O3. The piezoelectric ceramic is metallized with thin film electrodes so that a voltage can be applied to produce the desired mechanical expansion or contraction of the piezoelectric material. A number of companies manufacture piezoelectric ink jet print heads for industrial use. The manner in which the print head is constructed depends on the manufacturer. The two most common structures of print heads used in commercial printing applications involve cutting grooves or fingers into a piezoelectric ceramic plate. In the groove method, narrow rectangular grooves are cut into the piezoelectric plate at one end and extend almost to the other end of the plate. The grooves are narrow and deep. There are numerous grooves cut side by side, so that adjacent grooves share the same side walls. In a typical head there are one-hundred-and-twenty-eight (128) grooves. Thin film electrodes are deposited onto the walls of the grooves and then a cover is attached to the top of the piezoelectric plate to seal off the top of the grooves. A nozzle plate is attached on the end of the grooved plate where the grooves start. The nozzle plate is metal and has tiny holes machined in its surface spaced at distances to match the grooves in the grooved plate, so that one hole lines up with each groove. Ink is pumped through a manifold system located at the other end of the grooved plate filling all of the grooves with ink. During operation, a voltage pulse is applied across the groove walls, causing the walls to flex inward into the groove which squeezes ink out of the holes in the nozzle plate. By activating certain grooves in sequence droplets can be ejected toward the page to form characters on its surface.

The other design of ink jet print head uses the ceramic plate cut into fingers like a comb. A thin plate of piezoelectric ceramic is cut into a comb like structure with sixteen (16) or thirty-two (32) fingers. The ceramic is metallized with thin film electrodes before being diced into a comb, so that in the resultant structure, each finger has metal electrodes on both of its larger flat faces. The cuts extend almost the length of the ceramic. The solid end of the ceramic is then bonded down to a mounting block and the fingers extend forward into space. The fingers press against reservoirs of ink. These reservoirs have tiny nozzles on the side opposite to which the fingers press. The reservoirs are flexible so that when a voltage is applied across a given finger, that finger extends into the reservoir and forces a droplet from the nozzle on the opposite side of the reservoir. Again by activating the fingers in proper sequence, characters can be produced on the surface of the paper.

The two most common designs of industrial ink jet print heads described above suffer from many disadvantages. In the grooved plate design all of the grooves or ink channels are formed in the same piezoelectric ceramic plate so that if one channel fails it can't be individually repaired and typically the whole plate is ruined. This leads to high yield losses during manufacturing and consequently higher costs. The end user also must buy a whole new head when it fails; instead of having it repaired, increasing his overall system use cost. In the groove design the channels can fail for several reasons. Pores in the ceramic material can cause leaks across the channels effectively short circuiting the device. Nozzles can easily clog from particle debris in the inks. This clogging is exacerbated by the structure of the device, with the wider grooves terminating in the small diameter holes in the nozzle plate. Larger particles can be trapped and build up in the space around the nozzle, eventually clogging the nozzle. Ink is in contact with electrodes of the channels so electrically conducting or chemically reactive inks can't be used. The design is also not good for printing high viscosity inks or other substances such as glues. In short, the ink chemistry is severely constrained. The grooved plate print head manufacturing process is very difficult and it requires expensive equipment which also leads to high unit costs. The comb structure can't be used to achieve a high number of channels above sixty-four (64) channels so it is only used in applications where print quality is not of major concern. It also suffers from the problem that if one channel fails the entire piezoelectric comb must be replaced.

A number of patents discuss using glass tubes for the ink delivery channels and/or nozzles in piezoelectric print heads. Some mention the use of piezoelectric element attached to the glass tube to eject ink. However, all of these use glass in the form of rigid tubes or capillaries and not flexible hollow fibers. Another group of patents describe making nozzle arrays for electrostatic printers out of glass tubes, capillaries, and fibers. In these patents the glass is cut into very short segments to form only the nozzle array or orifice plate and is not used for entire ink delivery pathway. Since these printers are electrostatic they do not use a piezoelectric to drive ink out of the glass tubes. Because of the potential advantages of using glass tubes in ink jet printers, there has been prior work in this area. However, none of this work includes the use of flexible hollow glass fibers. All patents using glass as the ink delivery system use rigid tubes or capillaries that are not flexible. Such an approach suffers from three major problems. One, the outer diameters of the tubes are large and prevent closely spacing them in a nozzle array. Therefore, fabricating a print head with a high dots-per-inch is very difficult. Second, because the tubes are rigid they can only be softened by heat and then permanently bent into angles necessary to fabricate a nozzle array which again makes the fabrication of a print head difficult. Third, because the tubes are rigid and not flexible they are prone to breakage during assembly and subsequent use, so the heads would be difficult to make and they would not be robust for an industrial environment.

It is an object of the present invention to provide micro fluid dispensers using glass fibers and piezoelectric devices.

It is another object of the present invention to provide micro fluid dispensers using glass fibers and piezoelectric devices to be used ink printing devices.

SUMMARY OF THE INVENTION

A micro fluid dispenser including reservoir, glass tube, hollow glass fiber, a piezoelectric element and a controller. The reservoir is to hold fluid to be dispensed. The glass tube has a first end, a second end and a tube body. The first end of the glass tube is connected to the reservoir to receive the fluid. There is a hollow glass fiber for each glass tube. The hollow glass fiber has a first end, a second end and a fiber body. The first end of the hollow glass fiber is connected to the second end of the glass tube to receive the fluid. The second end of the hollow glass fiber has an open tip to act as a nozzle to dispense the fluid. The piezoelectric element forces the fluid out of each of the open tip. The controller controls activation of the piezoelectric element.

DETAILED DESCRIPTION

Figure 1:
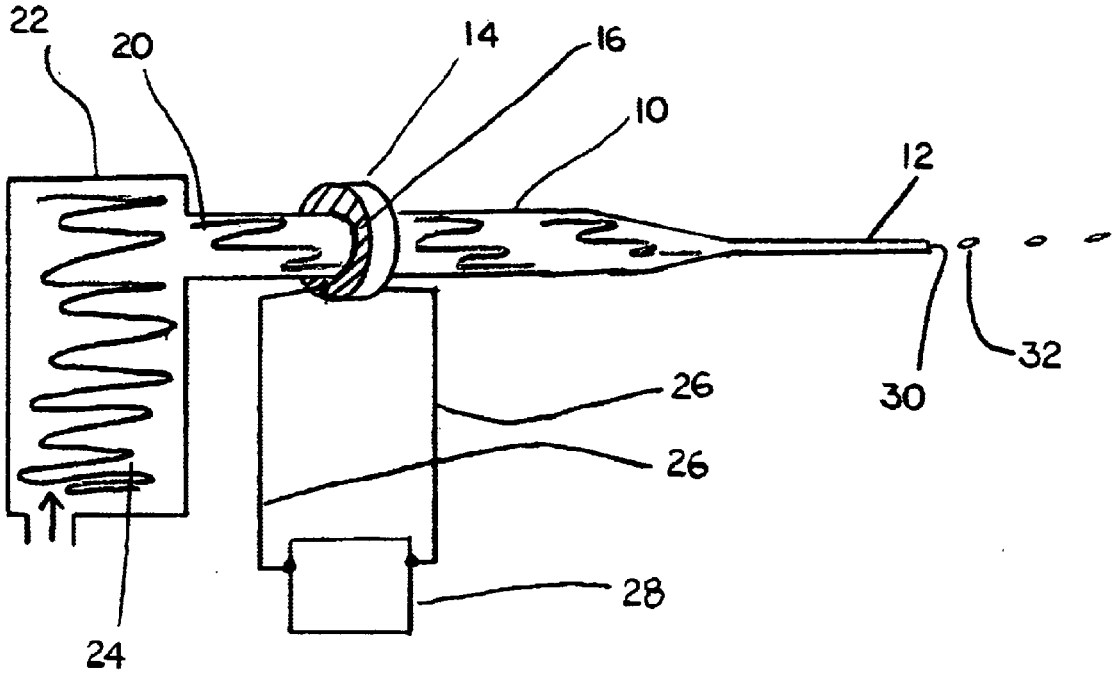
FIG. 1 is a view of a single glass tube and hollow glass fiber according to the present invention.

The present invention is micro fluid dispensers using hollow glass fibers. The present invention provides a new way to make ink jet print heads possible which overcome the disadvantages of current designs. It is based on the use of piezoelectric elements with separate flexible hollow glass fibers with and without glass tubes to act as channels for the ink delivery, as well as the nozzle for droplet ejection. By using a separate hollow glass fiber for each channel or ink pathway/nozzle combination, the print head can be repaired if it fails rather than being disposed. A channel that fails in the print head can be repaired by simply replacing that fiber and any glass tube associated with the fiber. The ability to replace individual channels will greatly increase in manufacturing yields and consequently reduce manufacturing costs compared to currently used piezoelectric ink jet print head designs. In addition, not only could heads be repaired in the factory to improve yields, but heads of this hollow glass fiber design already in the field could also be repaired so that customers could pay a lower price to repair heads rather than purchase a new one.

Glass is the ideal material to make the tube and fiber out of for many reasons. First glass is chemically inert and therefore will allow a very broad range of inks and chemicals to be printed or dispensed from the print head. In addition, putting the piezoelectric element outside the tube or fiber so that the electrodes don't contact the ink allows the print head to shoot electrically conducting ink without shorting out. Glass is also ideal because of its high stiffness, as compared to a polymer which are generally chemically inert. As a polymer suffers from the fact that it is softer than glass and expands more easily than glass. A print head produced using tubes of glass that neck down to flexible hollow glass fibers to carry the ink would not be as prone to clogging as current heads. Because the inside of the glass tube is atomically smooth and it gradually necks down to the nozzle there is nothing for particles to stick to and nowhere for them to lodge internally. As long as the particles are not larger than the smallest inner diameter of the fiber, the particles would be ejected through the nozzle and not build up into internal clogs. Because of the smooth pathway the ink would flow better than current heads which have numerous component interfaces and complex ink channel paths which impede ink flow. Since all channels are separate tubes there would be no possibility of ink leaking between channels.

The disadvantages of current print heads are overcome in the present invention by using the glass in the form of a thin, flexible, hollow fiber instead of a rigid tube or capillary. By reducing the diameter of glass tubes to a sufficiently small size the glass eventually becomes a thin fiber with distinctly different mechanical behavior from the rigid glass tube. The glass fiber is extremely flexible like nylon fishing line, so that it can be bent in any direction and actually coiled up in circles, as opposed to a tube or capillary of glass which breaks when bent severely. In the form of a fiber, the glass and the subsequent printer head it is made into is extremely robust. The following are embodiments employing hollow glass fibers in different arrangements with and without glass tubes to form a nozzle or an array of nozzles to be used in ink print heads.

FIG. 1 shows the simplest embodiment of the present invention using hollow glass fibers. FIG. 1 shows a small glass tube 10 drawn down to a tiny flexible hollow glass fiber 12 at one end. An example of dimensions of the glass tube 10 is a one-eighth inch diameter and a length of one inch before the transition to the hollow glass fiber 12. The glass tube 10 is inserted through a ring shaped piezoelectric element 14, which has electrodes 16 deposited on its two flat faces but not on its inner and outer diameter. The ring shaped piezoelectric element 14 does not have to be ring shaped. It could be of various shapes and sizes, for example a round block with a square hole for the tube, a rectangular block with a round or square hole, a U-shaped piece which the tube fits into, etc. The preferred material for the piezoelectric element in the present invention is ceramic, but the material could be any piezoelectric, such as single crystals or polymers. For the example shown in FIG. 1, the glass tube 10 is sized to just fit into the open inner diameter of the ring shaped piezoelectric element 14 and may be epoxy bonded in place. The non-fiber end 20 of the glass tube 10 is then inserted into a reservoir 22 filled with ink 24. Ink 24 from the reservoir 22, which is pressurized, fills the glass tube 10 and flows into the hollow glass fiber 12 by capillary action. Electrical lead wires 26 are attached to both electrodes 16 covering the flat faces of the piezoelectric element 14. Attachment of the electrical lead wires 26 is typically done by soldering. A controller 28, also sometimes called generator or power supply, is used to supply electrical power to and control the piezoelectric element 14. The controller 28 refers generally to all electrical equipment needed to supply electrical power to and control the piezoelectric element 14. The electrical lead wires 26 from the piezoelectric element 14 are connected to the controller 28.

Figure 2:
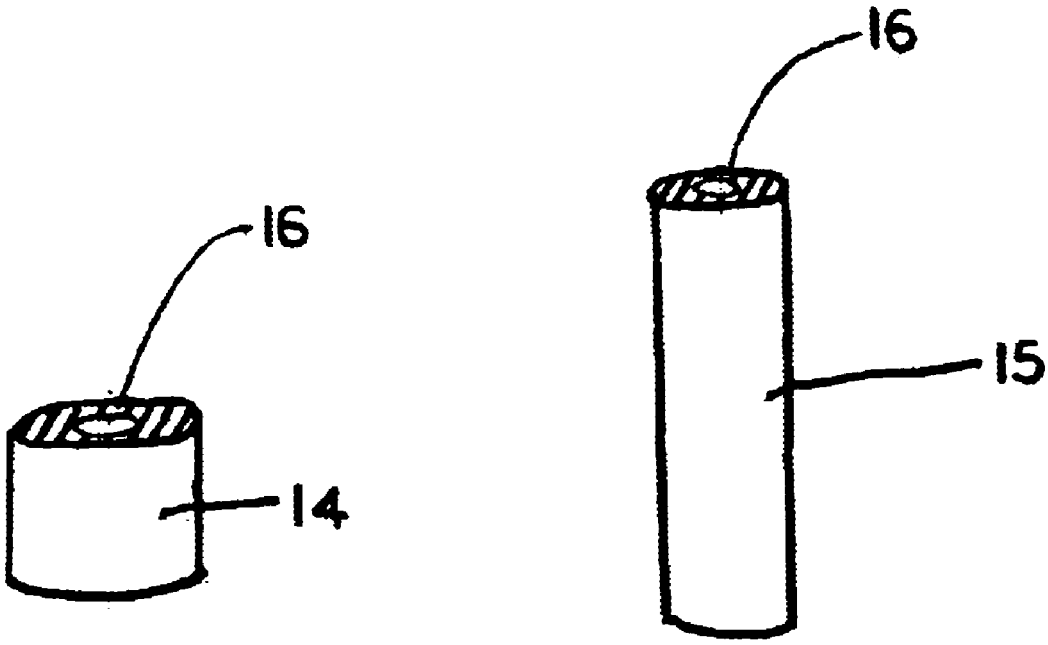
FIG. 2 is a perspective view of a piezoelectric element according to the present invention.

During operation of forcing ink 24 out of the glass tube 10, an electrical signal is generated by the controller 28 and transmitted to the piezoelectric element 14 using the electrical lead wires 26. The electrical signal is a voltage pulse of short time duration. The electrical lead wires 26 transmit the voltage pulse across the electrodes 16 on the flat faces of the piezoelectric element 14. FIG. 2 shows piezoelectric element 14 as a piezoelectric element with no voltage applied to it. FIG. 2 as shows piezoelectric element 15, which is piezoelectric element 14 when voltage has been applied to it. Note, the electrodes 16 on the flat faces of piezoelectric elements 14, 15. The voltage pulse causes the piezoelectric element 14 to stretch in its length, which causes its outer diameter and inner diameter to shrink, as shown by piezoelectric element 15 in FIG. 2. As described previously, a piezoelectric material expands or contracts when a voltage is applied, depending on the polarity of the voltage. The piezoelectric material is a "transducer" which converts the electrical signal from the controller into a mechanical movement. Because the voltage from the controller 28 is applied for only a very short time in a voltage pulse, it causes the piezoelectric material to shrink around the glass tube 10 and then relax back to its original diameter in a very short period of time. This mechanical impact against the glass tube 10 by the shrinking inner diameter of the piezoelectric element 14 creates a mechanical pressure pulse in the glass of the glass tube 10 at the point of impact within the inside diameter. This mechanical pressure pulse is like a short duration vibration or acoustic wave which can travel through solids and liquids at high speeds. The action of the piezoelectric element 14 on the glass tube 10 is more of an impact than a squeezing action because of the short time duration. The point of impact against the glass tube 10 is considered the area of impact for this and all other embodiments of the present invention.

The pressure pulse created by the piezoelectric element 14 at the point of impact of the piezoelectric element 14 against the glass tube 10 travels through the glass to the ink 24. The pressure pulse is transmitted into the ink 24 at the ink/glass interface. The pressure pulse then travels through the ink 24 into the hollow glass fiber 12. Upon reaching an open tip 30 of the hollow glass fiber 12, the pressure pulse forces out a droplet 32 of ink 24 from the open tip 30. The open tip 30 is basically a nozzle. Whereby, the nozzle is the orifice through which the ink 24 is ejected as a droplet 32 from the glass tube 10 and the hollow glass fiber 12. The pressure pulse actually moves in both directions in the glass tube 10. Whereby the ink 24 moving away from the piezoelectric element 14 forces some ink 24 back into the reservoir 22, as well as out of the open tip 30. When the pressure pulse is finished, a low pressure region of ink 24 remains in the glass tube 10 near the piezoelectric element 14. This low pressure region is refilled by ink 24 returning from the reservoir 22. The surface tension of the ink 24 at the open tip 30, holds the ink 24 at the open tip 30 and prevents the ink 24 from being drawn back into the glass tube 10 when the glass tube 10 refills with ink 24. The ink 24 is therefore only drawn from the reservoir 22. A one way valve could be used between the glass tube 10 and reservoir 22 to prevent the pressure pulse from causing ink 24 to flow back into the reservoir 22. The one way valve would only allow ink 24 to backfill into the glass tube 10 from the reservoir 22 following the pressure pulse. This would have the added benefit of redirecting more of the force of the pressure pulse and hence the ink flow forward to the open tip 30. Also, the piezoelectric element 14 could be metallized on various surfaces to produce different types of mechanical motions of the piezoelectric element 14 and therefore different types of impacts against the glass tube 10.

Figure 3:
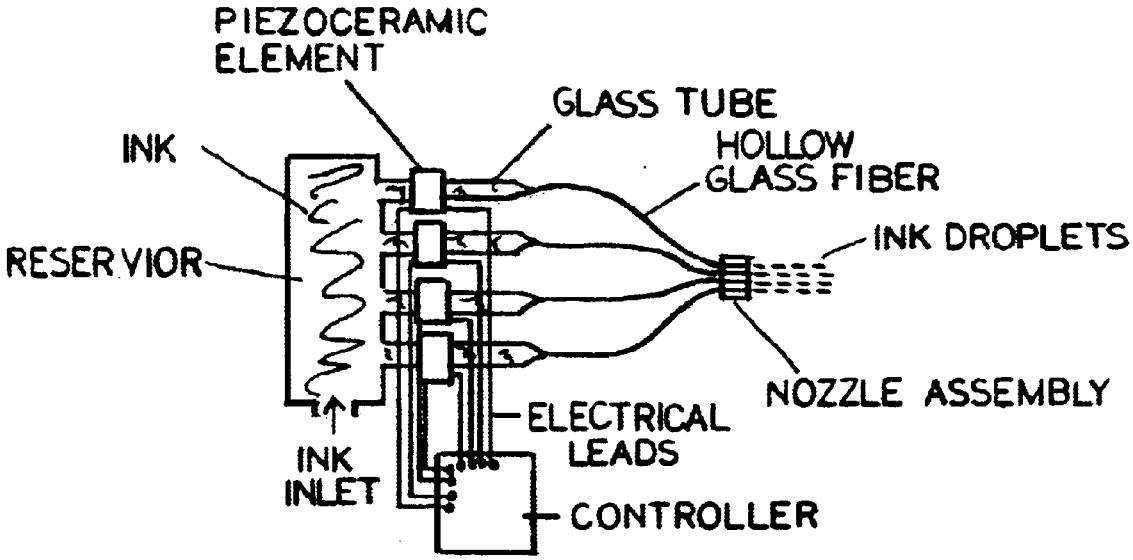
FIG. 3 is a schematic view of a multiple glass tube according to the present invention.
Figure 4:
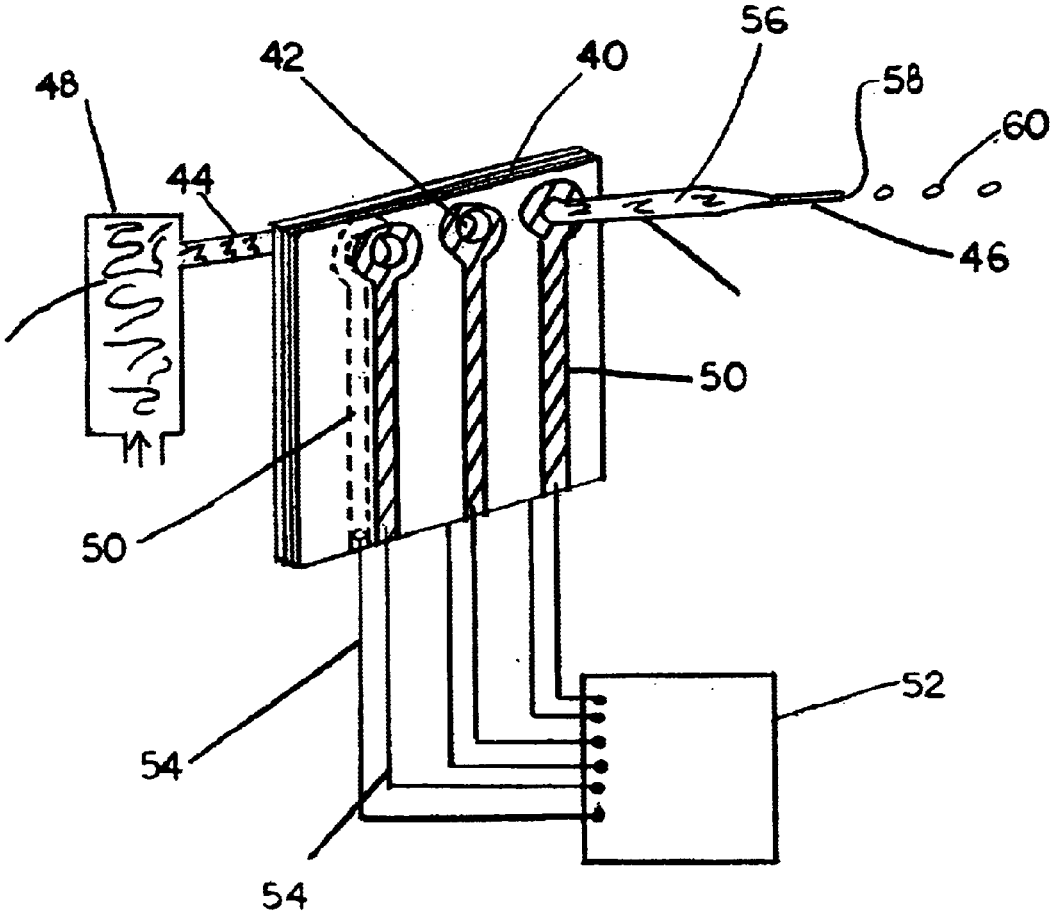
FIG. 4 is a perspective view of a plate configuration according to the present invention.
Figure 5:
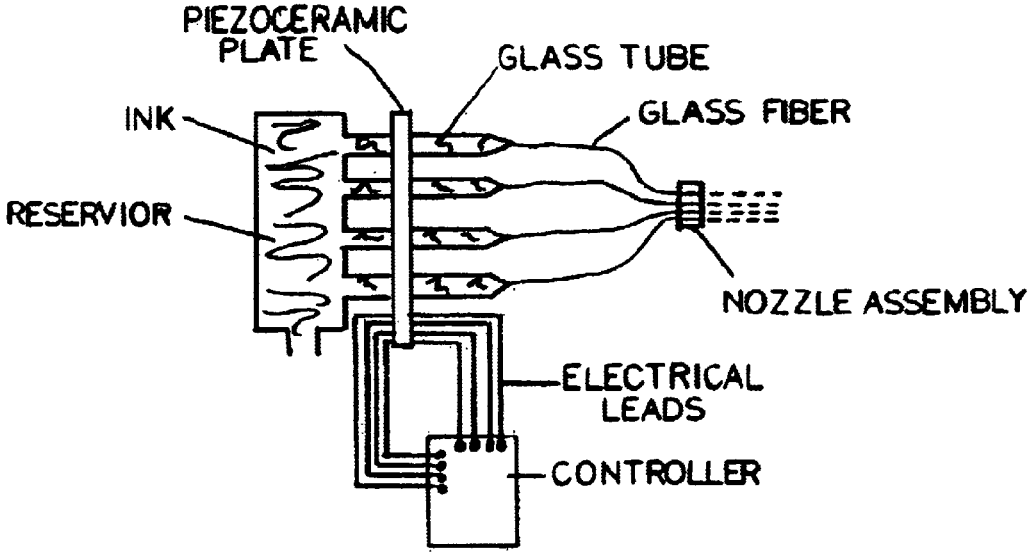
FIG. 5 is a schematic view of a plate configuration according to the present invention.

Using the principles of the embodiment shown in FIG. 1, a multi channel print head can be fabricated using two or more individual glass tubes with hollow glass fibers. FIG. 3 shows a schematic of a multiple channel print head of four glass tubes and hollow glass fibers using individual piezoelectric elements attached to each glass tube. The open tips of the hollow glass fibers are aligned in one dimensional or two dimensional arrays. The piezoelectric elements would be driven by voltage pulses from the controller in proper sequence to produce the desired drop pattern on the printing surface, such as paper. FIGS. 4–5 show a plate made of piezoelectric material which acts as the piezoelectric element, instead of using separate piezoelectric elements with separate leads. Therefore, one piezoelectric element could be used to activate all glass tubes individually.

FIG. 4 shows the plate 40 with several holes 42 of a diameter slightly larger than the outer diameter of the glass tubes 44. In FIG. 4, one glass tube 44 is shown inserted into one of the holes 42 of the plate 40 forming a single channel print head. The glass tube 44 and the plate 40 can be mated in a similar fashion to the one described for the single piezoelectric element. The glass tube 44 necks down to the hollow glass fiber 46 and connects at the other end to the reservoir 48. A thin film of electrical conducting material in patterns for electrodes 50 are applied on both sides of the plate 40 by either depositing directly to the surface of the plate 40 or depositing onto polymer layers which are subsequently glued to the plate 40 to carry the voltage signal to each hole 42 individually. The electrodes 50 would be around each hole 42 and would terminate at the edge of the plate 40 for external connection to the controller 52. The electrodes 50 allow a voltage to be applied to each hole 42 independently. Again, lead wires 54 are attached between the electrodes 50 on the piezoelectric plate 40 and the controller 52. The operation of the plate 40 as the piezoelectric element is similar to that described previously for the piezoelectric element. During operation, a voltage pulse is generated by the controller 52, travels through the lead wires 54 to the electrodes 50 on the plate 40 and around the holes 42 in the plate 40. The voltage pulse around the hole 42 on both sides of the plate 40 causes the piezoelectric material to expand in its thickness "locally" around the hole 42, which in turn causes the inner diameter of the hole 42 to shrink. The shrinking inner diameter of the hole 42 in the plate 40 impacts against the glass tube 44 and creates the pressure pulse in the glass of the glass tube 44. The pressure pulse travels through the ink 56 to the open tip 58 of the hollow glass fiber 46, where it causes a drop 60 of ink 56 to be ejected from the open tip 58. Ink 56 refills into the glass tube 44 with the same mechanism as previously described.

Figure 6:
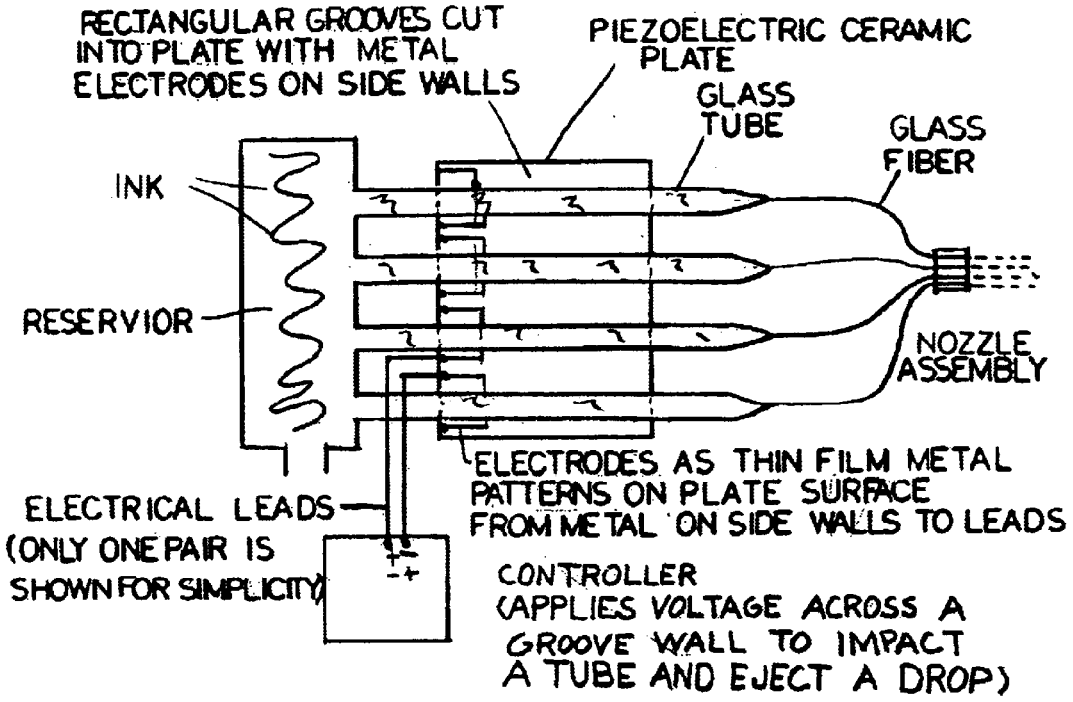
FIG. 6 is a schematic view of a plate configuration with grooves according to the present invention.

FIG. 5 shows a schematic of a piezoelectric plate with four glass tubes to form a print head with more than one nozzle. The holes and therefore the glass tubes can be arranged in one dimensional or two dimensional arrays and be closely spaced. The non-fiber ends of all of the glass tubes would be attached to a manifold system for ink delivery. The open tips can all be aligned in one dimensional or two dimensional arrays to form a nozzle assembly. A controller would be used to apply a voltage pulse to each hole in sequence to produce pressure pulses in each tube to eject droplets from the open tip of a particular hollow glass fiber. Such an array could consist of any number of glass tubes and hollow glass fibers, in the range of two to thousands. Alternately, all of the glass tubes in a multi channel print head need not be activated by the same piezoelectric element There may be cases where more than one piezoelectric element is used, yet each piezoelectric element contains more than one glass tube. One reason for more than one piezoelectric element in a multi channel print head is an arrangement that fits into a desired housing of a print head rather than one large piezoelectric element which dictates the design of the housing. Also, other configurations of the piezoelectric plate are envisioned, such as a plate with rectangular grooves shown in FIG. 6. The grooves are cut to receive the glass tubes, whereby the glass tubes would simply be pressed into the grooves. Electrodes on either side of the grooves, connected to the controller, would activate the piezoelectric material and cause the walls of the groove to impact against the glass tube.

Figure 7:
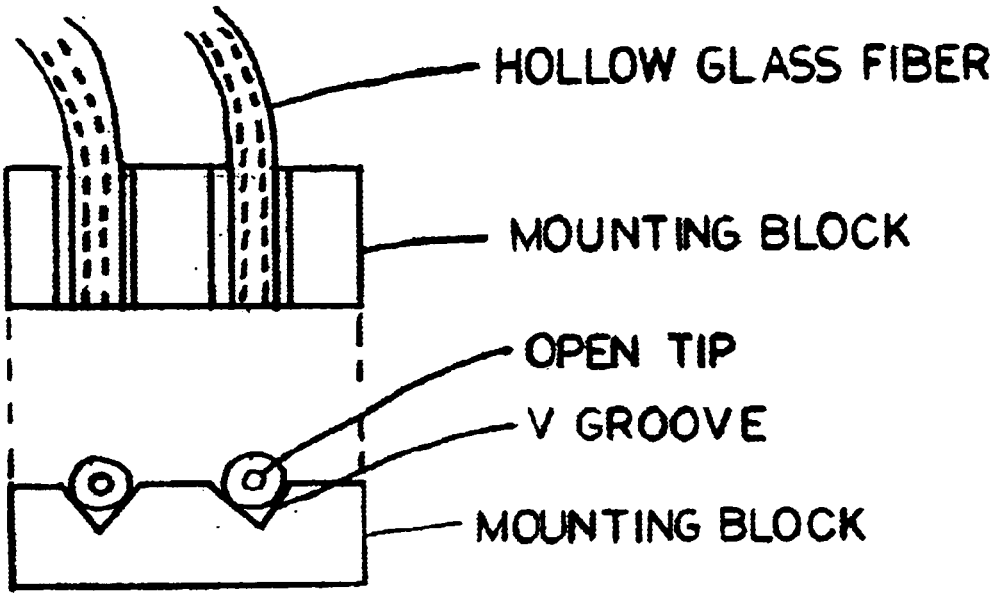
FIG. 7 is a schematic view of a nozzle assembly according to the present invention.
Figure 8:
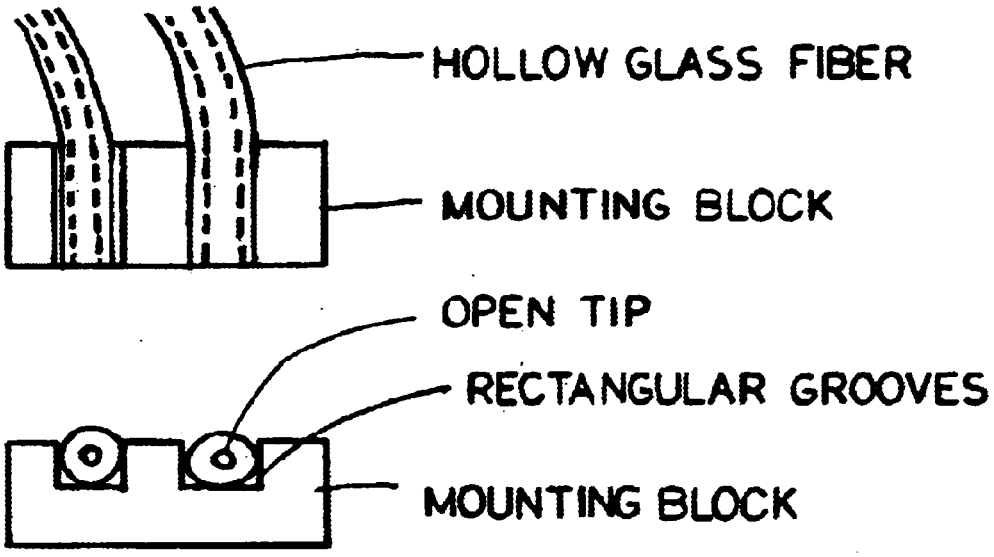
FIG. 8 is a schematic view of a nozzle assembly according to the present invention.
Figure 9:
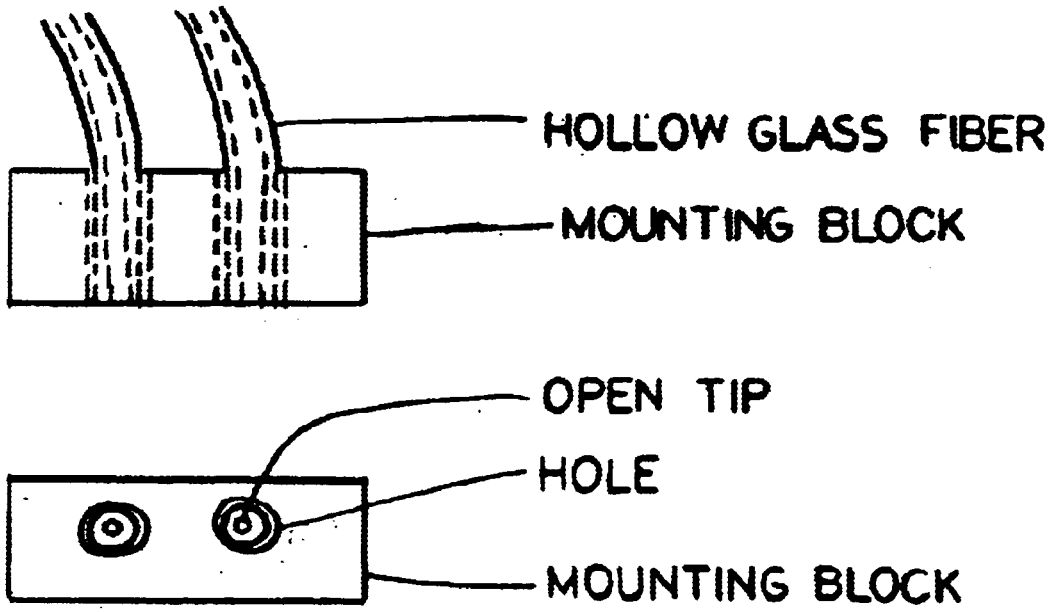
FIG. 9 is a schematic view of a nozzle assembly according to the present invention.

There are ways to make a hollow glass fiber without starting with a glass tube, so that all that is made is a hollow glass fiber. These hollow glass fibers could then attach directly to a reservoir without an intermediate glass tube. The piezoelectric element can attached about the hollow glass fiber as a replacement for the glass tube. The piezoelectric element could be attached at the open tip or anywhere along the length of the hollow glass fiber, rather than at the large outer diameter section of the glass tube. FIGS. 7–12 show schematics of nozzle assemblies with a mounting block 70 and multiple hollow glass fibers 72 having open tips 74. Grooves or holes are machined into the mounting block to hold the open tips of the hollow glass fibers rigidly in place. FIGS. 7–9 show examples of such nozzle assemblies using different mounting block configurations. FIG. 7 shows a mounting block with V-grooves. FIG. 8 shows a mounting block with rectangular grooves. FIG. 9 shows a mounting block with circular holes. The mounting block could be made out of a variety of materials such as glass, metal, or silicon. The open tips of the hollow glass fibers would be held in place with some type of bonding agent such as a polymer adhesive, epoxy or a low melting point glass. The open tips of the hollow glass fibers would typically be aligned parallel and equidistant from one another to form the nozzle assembly. The hollow glass fibers must be held very straight to ensure proper alignment of the open tips and hence ensure that the droplets of ink come out of the open tips in the proper direction. Small misalignments in the hollow glass fibers can cause large errors on the printed page, because of the relatively large distance the drops travel through the air from the open tips to the paper.

Figure 10:
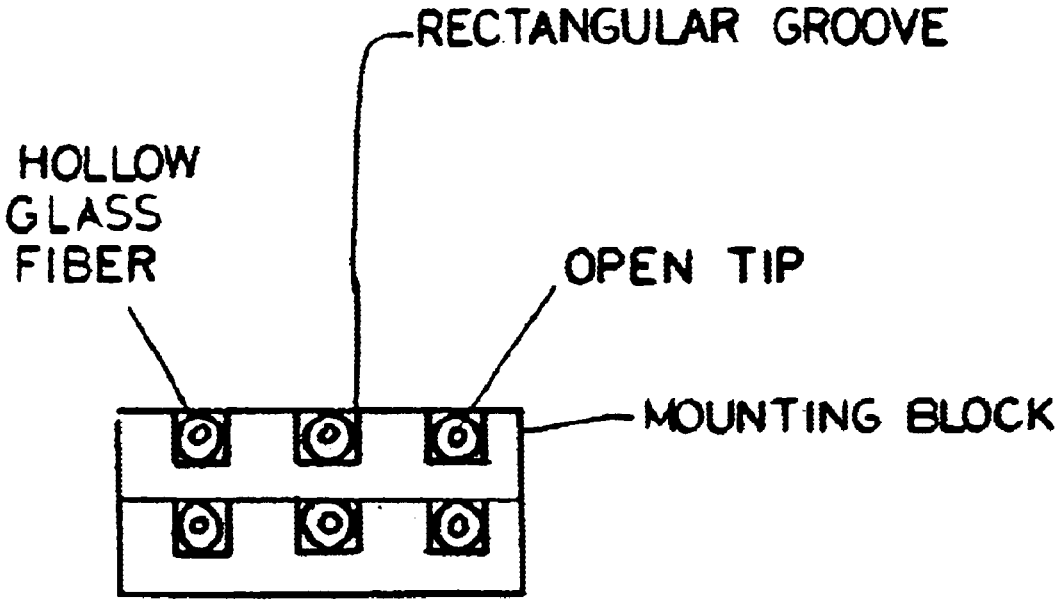
FIG. 10 is a schematic view of a nozzle assembly according to the present invention.
Figure 11:
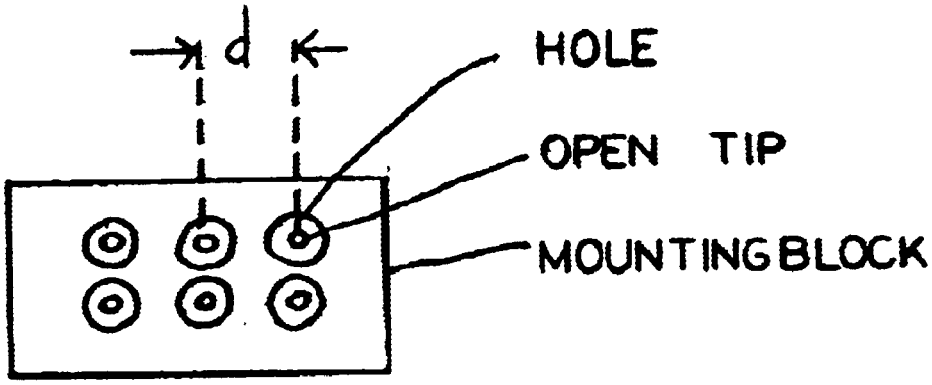
FIG. 11 is a schematic view of a nozzle assembly according to the present invention.
Figure 12:
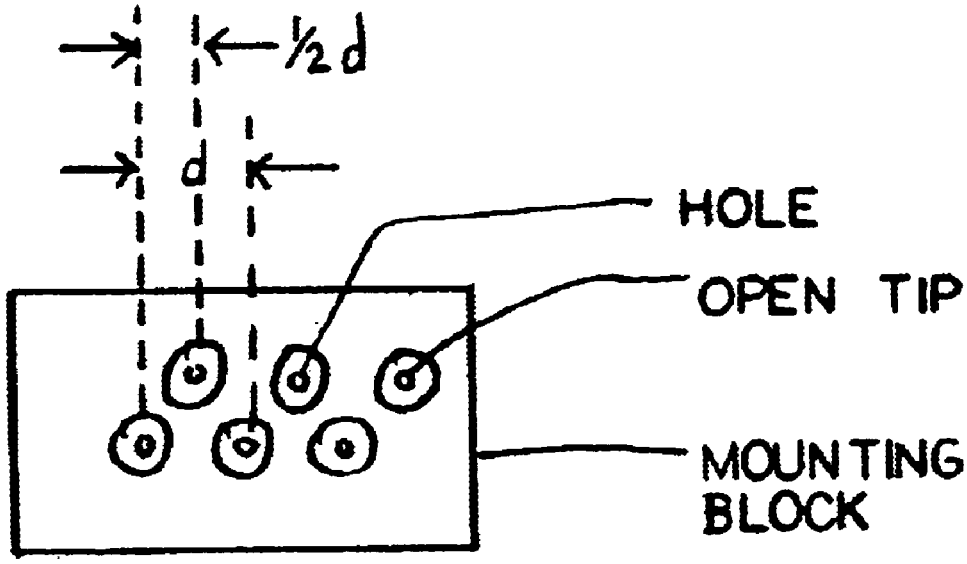
FIG. 12 is a schematic view of a nozzle assembly according to the present invention.

FIGS. 7–9 show only one-dimensional linear arrays in the nozzle assembly, but two-dimensional arrays are also possible. A two dimensional nozzle assembly can be produced by stacking the V-groove or rectangular groove mounting blocks. FIG. 10 shows the rectangle groove version. A two dimensional array could also be produced by simply drilling two dimensional arrays of holes in the mounting block as shown in FIGS. 11 and 12. Two dimensional arrays might be desirable for two reasons. First, extra hollow glass fibers could be available in case a hollow glass fiber clogs or fails. In FIGS.11 and 12, if a hollow glass fiber of the lower row fails, use of that hollow glass fiber could easily be switched to the next hollow glass fiber above. This switching of hollow glass fibers would be accomplished so that characters would still print properly on the page. One method to accomplish this would be by switching use to all of the hollow glass fibers in the row above. Alternatively, only the clogged hollow glass fiber use would be switched to the use of the hollow glass fiber above and the change could be compensated by properly adjusting the timing of the hollow glass fiber firings by the controller. Since the paper usually moves in a direction perpendicular to the rows of arrays from the lower array row to the upper one, the controller could slightly delay the firing of the hollow glass fibers in the upper row relative to the hollow glass fibers in the lower row. This allows the drops to all be in the same line when the drops hit the page. On the paper, then it would appear that all the hollow glass fibers firing ink were in the same row. This redundancy of hollow glass fibers would greatly extend the lifetimes of the overall nozzle assembly. Additional array rows of hollow glass fibers could be added above the ones shown in FIGS. 10 and 12 to make the print head last even longer.

The second advantage of two dimensional arrays in the nozzle assembly is the ability to achieve a higher print quality. If the print head remains stationary and is not moved back and forth across the paper perpendicular to the way the paper moves under the print head, the spacing of hollow glass fibers in the nozzle assembly determines the overall quality of the printed characters. The print quality of a print head is defined by the number of dots of ink which are produced on one inch of the paper perpendicular to the paper travel, if all the hollow glass fibers in the print head are fired at once. The dots-per-inch of the print head is equal to the hollow glass fiber spacing in the print head, if the print head remains stationary during printing. The closer the hollow glass fiber spacing in the nozzle assembly, the higher the dots-per-inch of the print head and the higher the quality of the printed characters on the paper. A way to achieve a higher dots-per-inch than can be achieved by closely spacing a single row of hollow glass fibers in the nozzle assembly is to form a staggered two dimensional array of the hollow glass fibers, as shown in FIG. 12. Since the paper travels perpendicular to the nozzle assembly, this would produce a higher dots-per-inch on the paper. Again as described previously, the firing of the hollow glass fibers in the bottom row could be delayed slightly relative to the upper row by the controller, so that the drops all reach the page in the same line and it appears on the paper that all of the hollow glass fibers are in the same row. The staggered two dimensional hollow glass fiber array shown in FIG. 12 would produce dots spaced at one-half the distance from each other on the paper that a one dimensional hollow glass fiber array would produce with the same hollow glass fiber spacing in a given row. Therefore, the staggered two dimensional hollow glass fiber array would have twice the dots-per-inch and give a better print quality than a one dimensional hollow glass fiber array. Additional staggered rows of hollow glass fibers could be added above the first two rows in FIG. 12 to give even higher print quality. The above described methods of nozzle assembly use of the hollow glass fibers can also be applied to the embodiments that utilize the glass tube and hollow glass fiber combination. Whereby, the hollow glass fibers and mounting block can be used in conjunction with the glass tubes.

The mounting block in the nozzle assembly could also be made of piezoelectric ceramic and metallized to act as the piezoelectric element in the print head instead of having the piezoelectric element or elements attached to the hollow glass fibers. Piezoelectric ceramics could be used in all of the configurations shown in FIGS. 7–12. In the rectangular groove case shown in FIGS. 8, 10, the metal coatings of electrodes could be applied to the sides of the groove walls. Application of the voltage from the controller would cause the walls to bend inwards and impact a given hollow glass fiber to force an ink drop from the open tip. For the hole-type configuration shown in FIGS. 9, 11, and 12, the metal coatings of electrodes could be on the flat faces of the mounting block, around the holes, similar to the configuration described for the multi channel print head using a plate as a single piezoelectric element. Application of voltage from the controller would cause the inner diameter of the holes to shrink, impact the hollow glass fibers, and force an ink droplet from the open tip.

The embodiments of ink jet print head described above can also be used as a precision fluid dispenser. Such a system could be used to dispense small quantities of various chemicals and fluids to be used in chemical and biological applications. The dispenser could dispense an array of droplets of the same fluid or if a different reservoir were used for each hollow glass fibers, the dispenser could dispense different chemicals from each hollow glass fiber. A computer could be used to automatically dispense various amounts of each chemical onto a surface or into a test tube to study chemical reactions or biological processes. The hollow glass fibers would be chemically inert and quite useful in these types of applications. The embodiments of the inkjet print head described above can also be used as an atomizer or nebulizer. An atomizer or nebulizer is essentially a spray nozzle which forms fine droplets from of a fluid by spraying the fluid into air or into another gas. The fine droplets become suspended in air for a period of time, forming an aerosol. Typically, such nozzles produce a spray of these droplets with a wide range of droplet size, trajectory, and velocity. The use of the glass fiber activated by the piezoelectric to atomize the fluid, would allow more control than conventional nozzles over such parameters as droplet size, trajectory, and velocity. In certain scientific instruments and other equipment, control of these droplet parameters is very important. The hollow glass fibers could again be arrayed into multiple nozzle arrays of a linear, circular, or other type of pattern. Another advantage of the hollow glass fiber is that more reactive chemicals and acids could be sprayed than is possible with nozzles which contain metal components. Also, the spray chemicals purity would be at a higher level, since the chemicals would have negligible reaction with the glass components.

While different embodiments of the invention have been described in detail herein, it will be appreciated by those skilled in the art that various modifications and alternatives to the embodiments could be developed in light of the overall teachings of the disclosure. Accordingly, the particular arrangements are illustrative only and are not limiting as to the scope of the invention that is to be given the full breadth of any and all equivalents thereof.

What is claimed is:

1. A micro fluid dispenser comprising:

at least one reservoir to hold fluid to be dispensed;

at least one glass tube having a first end, a second end and a tube body between said first and second ends, said first end of said at least one glass tube connected to said reservoir to receive said fluid into said tube body;

a hollow glass fiber for said at least one glass tube, said hollow glass fiber having a first end, a second end and a fiber body between said first and second ends, said first end of said hollow glass fiber connected to said second end of said glass tube to receive said fluid into said fiber body, said second end of said hollow glass fiber having an open tip to act as a nozzle to dispense said fluid, said hollow glass fiber is flexible to allow positioning of said open tip a nozzle assembly;

a piezoelectric element to force said fluid out of said open tip of said hollow glass fiber, said piezoelectric element including connections to a voltage source to activate said piezoelectric element; and a controller to control activation of said piezoelectric element, said controller connected to said voltage source to control activation of said piezoelectric element.

2. The micro fluid dispenser of claim 1, wherein said piezoelectric element is located about said glass tube to impact said glass tube when activated by said controller, whereby said impact produces an energy to force said fluid out of said open tip.

3. The micro fluid dispenser of claim 1, wherein said piezoelectric element is located about said hollow glass fiber to impact said hollow glass fiber when activated by said controller, whereby said impact produces an energy to force said fluid out of said open tip.

4. A method of dispensing fluid, using at least one reservoir to hold fluid to be dispensed; a least one hollow glass fiber, said hollow glass fiber having a first end a second end and a fiber body between said first end second ends, said first end connected to said reservoir to receive said fluid into said fiber body, said second end having an open tip to act as a nozzle to dispense said fluid, said hollow glass fiber is flexible to allow positioning, of said open tips in a nozzle assembly; a piezoelectric element located about said at least one hollow glass fiber to impact said hollow glass fiber to force said fluid out of each of said open tip of said hollow glass fiber due to an energy imparted to said fluid due to said impact, said piezoelectric element including connections to a voltage source to activate said piezoelectric element; and a controller to control activation of said piezoelectric element, said controller connected to said voltage source to control activation of said piezoelectric element, comprising:

activating said piezoelectric element using said controller to impact against said at least one hollow glass fiber to produce an energy wave though said fluid which forces said fluid to move along said at least on hollow glass fiber and out of said open tip.

5. The micro fluid dispenser of claim 2, wherein there is a piezoelectric clement for said glass tube.

6. Tho micro fluid dispenser of claim 3, wherein there is a piezoelectric element for said hollow glass fiber.

7. The micro fluid dispenser of claim 1, wherein said nozzle assembly is said piezoelectric element.

8. The micro fluid dispenser of claim 2, wherein there is a plurality of said glass tubes: wherein said piezoelectric element includes a receiving area for each of said class tubes; and wherein said piezoelectric element includes an impact area for each of said glass tubes to provide an impact to produce an energy to force said fluid out of each of said open tips.

9. The micro fluid dispenser of claim 8, wherein said piezoelectric element includes connections to a voltage source for each of said impact areas to individually activate each of said impact areas using said controller.

10. The micro fluid dispenser of claim 3, wherein there is a plurality of said hollow glass fibers; wherein said piezoelectric element includes a receiving area for each of said hollow glass fibers; and wherein said piezoelectric element includes en impact area for each of said hollow glass fibers to provide an impact to produce an energy to force said fluid out of each of said open tips.

11. The micro fluid dispenser of claim 10, wherein said piezoelectric element includes connections to a voltage source for each of said impact areas to individually activate each of said impact areas using said controller.

12. The micro fluid dispenser of claim 1, wherein there is a plurality of said glass tubes; and wherein a plurality of open tips of a plurality of said hollow glass fibers are mounted together in an array to form a fluid distribution head for said fluid.

13. The micro fluid dispenser of claim 12, wherein said hollow glass fibers are flexible to allows positioning of said open tips in said fluid distribution head.

14. The micro fluid dispenser of claim 12, wherein there are at least two reservoirs; and wherein connection of said glass tubes is divided between said at least two reservoirs.

15. The micro fluid dispenser of claim 12, wherein said piezoelectric element is located about said glass tubes to impact said glass tubes when activated by said controller, whereby said impact produces an energy to force said fluid out of said open tips.

16. The micro fluid dispenser of claim 12, wherein said piezoelectric clement is located about said hollow glass fibers to impact said hollow glass fibers when activated by said controller, whereby said impact produces an energy to force said fluid out of said open tips.

17. The micro fluid dispenser of claim 15, wherein there is a piezoelectric element for each glass tube.

18. The micro fluid dispenser of claim 16, wherein there is a piezoelectric element for each of said hollow glass fibers.

19. The micro fluid dispenser of claim 12, wherein said plurality of hollow glass fibers are mounted together in said piezoelectric element to form said fluid distribution head.

20. The micro fluid dispenser of claim 15, wherein said piezoelectric element includes a receiving area for each of said glass tubes; and wherein said piezoelectric element includes an impact area for each of said glass tubes to provide an impact to produce an energy to force said fluid out of each of said open tips.

21. The micro fluid dispenser of claim 20, wherein said piezoelectric element includes connections to a voltage source for each of said impact areas to individually activate each of said impact areas using said controller.

22. The micro fluid dispenser of claim 16, wherein said piezoelectric element includes a receiving area for each of said hollow glass fibers; and wherein said piezoelectric element includes an impact area for each of said hollow glass fibers to provide an impact to produce an energy to force said fluid out of each of said open tips.

23. The micro fluid dispenser of claim 22, wherein said piezoelectric element includes connections to a voltage source for each of said impact areas to individually activate each of maid impact areas using said controller.

24. A micro fluid dispenser comprising:

at least one reservoir to hold fluid to be dispensed;

at least one hollow glass fiber, said hollow glass fiber having a first end, a second end and a fiber body between said first and second ends, said first end connected to said reservoir to receive said fluid into said fiber body, said second end having an open tip to act as a nozzle to dispense said fluid, said hollow glass fiber is flexible to allow positioning of said open tip in a nozzle assembly;

a piezoelectric element located about said at least one hollow glass fiber to impact said hollow glass fiber to force said fluid out of said open tip of said hollow glass fiber due to an energy imparted to said fluid due to said impact, said piezoelectric element including connections to a voltage source to activate said piezoelectric element; and a controller to control activation of said piezoelectric element, said controller connected to said voltage source to control activation of said piezoelectric element.

25. The micro fluid dispenser of claim 24, wherein there is a piezoelectric element for said hollow glass fiber.

26. The micro fluid dispenser of claim 24, wherein there is a plurality of said hollow glass fibers; wherein said piezoelectric element includes a receiving area for each of said hollow glass fibers; and wherein said piezoelectric element includes an impact area for each of said hollow glass fibers to provide an impact to produce an energy to force said fluid out of each of said open tips.

27. The micro fluid dispenser of claim 26, wherein said piezoelectric element includes connections to a voltage source for each of said impact areas to individually activate each of said impact areas using said controller.

28. The micro fluid dispenser of claim 27, and wherein said open tips of said hollow glass fibers are mounted together in an array to form a fluid distribution head for said fluid.

29. The micro fluid dispenser of claim 25, wherein there are at least two reservoirs; and wherein connection of hollow glass fibers is divided between said at least two reservoirs.

30. The micro fluid dispenser of claim 24, wherein said hollow glass fibers are flexible to allow positioning of said open tips in a nozzle assembly.

31. The micro fluid dispenser of claim 28, wherein said plurality of hollow glass fibers are mounted together in said piezoelectric element to form said fluid distribution head.

32. The micro fluid dispenser of claim 30, wherein said nozzle assembly is said piezoelectric element.

33. A method of dispensing fluid, using at least one reservoir to hold fluid to be dispensed; at least one glass tube having a first end, and a second end and a tube body between said first and second ends, said first end of said glass tube connected to said reservoir to receive said fluid into said tube body; a hollow glass fiber for each glass tube, said hollow glass fiber having a first end, a second end and a fiber body between said first and second ends, said first end of said fiber body connected to said second end of said glass tube to receive said fluid into said fiber body, said second end having an open tip to act as a nozzle to dispense said fluid, said hollow glass fiber is flexible to allow positioning of said open tips in a nozzle assembly; a piezoelectric element located about said at least one glass tube to impact said one glass tube to force said fluid out of said open tip of said hollow glass fiber due to an energy imparted to said fluid due to said impact, said piezoelectric element including connections to a voltage source to activate said piezoelectric element, and a controller to control activation of said piezoelectric element, said controller connected to said voltage source to control activation of said piezoelectric element, comprising:

activating said piezoelectric element using said controller to impact against said at least one glass tube to produce an energy wave through said fluid which forces said fluid to move along said at least one glass tube, into said hollow glass fiber and out of said open tip.

34. The method of claim 33, wherein said piezoelectric element is for said glass tube.

35. The method of claim 33 wherein there is a plurality of said glass tubes; wherein said piezoelectric element includes a receiving area for each of said glass tubes; and wherein said piezoelectric element includes an impact area for each of said glass tubes to provide an impact to produce an energy to force said fluid out of each of said open tips.

36. The method of claim 35, wherein said piezoelectric element includes connections to a voltage source for each of said impact areas to allow said controller to individually activate each of said impact areas using said controller.

37. The method of claim 4, wherein said piezoelectric element includes connections to a voltage source for each of said impact arms to allow said controller to individually activate each of said impact areas using said controller.

38. The method of claim 4, wherein said piezoelectric element is for said hollow glass fiber.

39. The method of claim 4, wherein there is a plurality of said hollow glass fibers; wherein said piezoelectric element includes a receiving area for each of said hollow glass fibers; and wherein said piezoelectric element includes an impact area for each of said hollow glass fibers to provide an impact to produce an energy to force said fluid out of each of said open tips.

* * * * *